US008787800B2

(12) United States Patent
Tanner et al.

(10) Patent No.: US 8,787,800 B2
(45) Date of Patent: Jul. 22, 2014

(54) APPARATUS TO RECEIVE A DEVELOPER ROLLER

(75) Inventors: Christopher S. Tanner, San Diego, CA (US); David Sabo, San Diego, CA (US); Eric G. Nelson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 337 days.

(21) Appl. No.: 13/408,931

(22) Filed: Feb. 29, 2012

(65) Prior Publication Data

US 2013/0223888 A1 Aug. 29, 2013

(51) Int. Cl.
*G03G 15/10* (2006.01)

(52) U.S. Cl.
CPC ..... *G03G 15/10* (2013.01)
USPC ..... 399/237; 399/249

(58) Field of Classification Search
CPC ..... G03G 15/10
USPC ..... 399/237–239, 249
See application file for complete search history.

(56) References Cited

U.S. PATENT DOCUMENTS

| | | | | |
|---|---|---|---|---|
| 6,022,158 | A | 2/2000 | Nakayama et al. | |
| 6,484,002 | B2 | 11/2002 | Shifley et al. | |
| 6,651,973 | B2 | 11/2003 | Gaarder et al. | |
| 7,221,889 | B2 | 5/2007 | Patton et al. | |
| 2001/0041080 | A1 * | 11/2001 | Higeta et al. | 399/103 |
| 2008/0267660 | A1 * | 10/2008 | Schneider et al. | 399/119 |
| 2010/0083857 | A1 | 4/2010 | Michels et al. | |
| 2011/0052293 | A1 | 3/2011 | Vejtasa et al. | |
| 2012/0027468 | A1 * | 2/2012 | Nelson et al. | 399/264 |

FOREIGN PATENT DOCUMENTS

| | | | |
|---|---|---|---|
| CH | 668939 | A5 | 2/1989 |
| JP | 2011089342 | A | 5/2011 |

* cited by examiner

*Primary Examiner* — Walter L Lindsay, Jr.
*Assistant Examiner* — Jessica L Eley

(57) ABSTRACT

An apparatus to receive a developer roller for a printing device. The apparatus comprises a base assembly including end caps at opposing ends. The base assembly includes a receptacle for a developer roller having rotary bearings. Each end cap includes first and second datum pins and a clamp containing a spring member. Each clamp, when locked in place in part by action of the spring member, is to push against a corresponding rotary bearing when the developer roller is installed in the base assembly. The rotary bearing being forced by the clamp into contact with the first and second datum pins to position the developer roller in the base assembly.

20 Claims, 8 Drawing Sheets

APPARATUS TO RECEIVE A DEVELOPER ROLLER

BACKGROUND

Some types of printing systems (e.g., liquid electro photographic printers) include one or more binary ink developers. Printing systems that use binary ink developers are structurally complicated machines and the binary ink developer itself is a complicated and expensive device. Binary ink developers eventually must be replaced and replacement of such developers may not be easy, particularly in the face of tight tolerance requirements between the roller and other components in the printing system.

BRIEF DESCRIPTION OF THE DRAWINGS

For a detailed description of various examples, reference will now be made to the accompanying drawings in which.

DETAILED DESCRIPTION

One component of a binary ink developer is a developer roller. The lifespan of the developer roller may be shorter than the lifespan of the rest of the binary ink developer. The implementations described herein are directed to binary ink developer with a replaceable developer roller. The structure included in the binary ink developer roller to facilitate its removal and replacement avoids the need for tools to be used when replacing the developer roller. Further, the disclosed structure enables the developer roller to be precisely located within the binary ink developer. Precise location of the developer roller relative to a main electrode ensures proper operation of the binary ink developer.

Figure 1:
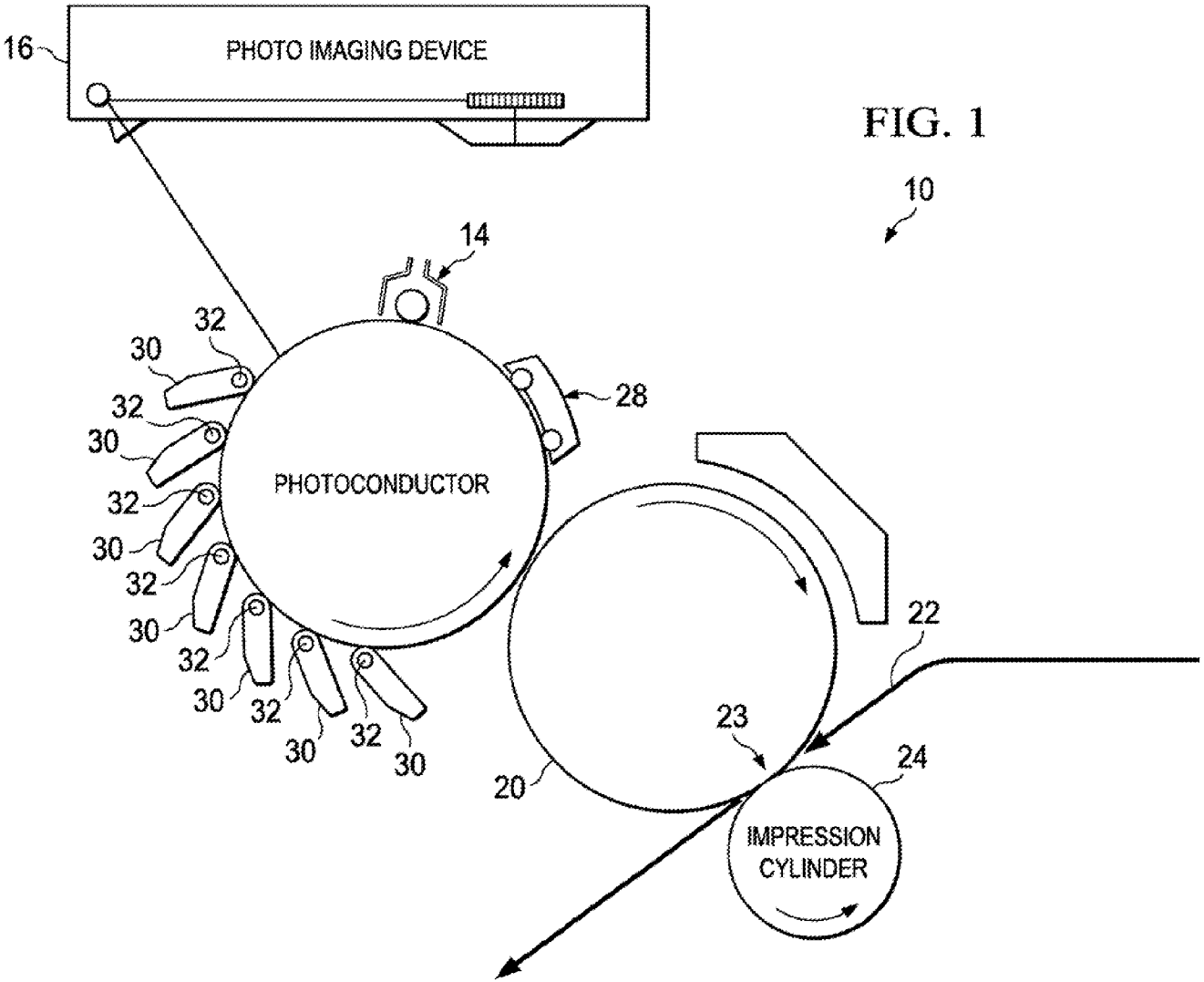
FIG. 1 shows a printing system in accordance with an example.

FIG. 1 illustrates an example of a printing system 10. In the example shown in FIG. 1, the printing system 10 represents a liquid electro-photographic (LEP) printing system, although printing system 10 may be representative of other types of printers. As shown, the printing system 10 includes a photoconductor 12, a charging device 14, a photo imaging device 16, an intermediate transfer member 20, and an impression cylinder 24. One or more binary ink developer (BID) assemblies 30 are also provided adjacent the photoconductor 12. The example of FIG. 1 includes multiple BIDs 30, one for each color including, for example, cyan, magenta, yellow, and black as well as other colors as desired such as orange, green, violet, white, light cyan, and light magenta. The number of different colors and the particular colors can be varied as desired.

In printing system 10 a uniform electrostatic charge may be applied to a photoconductive surface such as the outer surface of a photoconductor 12 by a scorotron, charge roller, or other suitable charging device 14. The photoconductor 12 used for liquid electro photography (LEP) printing may be referred to as a photo imaging plate (PIP). A scanning laser or other suitable photo imaging device 16 exposes selected areas on photoconductor 12 to light in the pattern of the desired printed image to dissipate the charge on the areas of photoconductor 12 exposed to the light. In discharge area development (DAD), for example, the discharged areas on photoconductor 12 form an electrostatic image which corresponds to the image to be printed. This electrostatic image is a "latent" image because it has not yet been developed into a toner image. A thin layer of liquid toner is applied to the patterned photoconductor 12 using the various BID assemblies 30. Each BID assembly 30 includes a developer roller 32 that supplies ink to the photoconductor 12 as the developer roller 32 rotates against the photoconductor 12.

The latent image on photoconductor 12 is developed through the application of liquid toner from the developer rollers 32. The liquid toner adheres to the discharged areas of photoconductor 12 in a uniform layer of toner on photoconductor 12, thereby developing the latent electrostatic image into a toner image. The toner image is transferred from photoconductor 12 to the intermediate transfer member 20 and then from the intermediate transfer member 20 to print medium 22 as the print medium passes through a nip 23 between intermediate transfer member 20 and the impression cylinder 24. Print medium 22 represents generally any suitable print medium (e.g., paper) and may be delivered to printing system 10 as a continuous web dispensed from a roll or as individual sheets. A discharging device 26 (e.g., a laser) removes residual charge from photoconductor 12 and toner residue is removed at a cleaning station 28 in preparation for developing the next image or for applying the next toner color plane.

Intermediate transfer member 20 may include a removable, replaceable blanket wrapped around a drum. The comparatively soft, compliant blanket is heated to drive off most of the carrier fluid component of the liquid toner. The thin layer of toner is then transferred, and simultaneously fused, to print medium 22 through the application of pressure at the nip 23 between the intermediate transfer member 20 and the impression cylinder 24.

Figure 2:
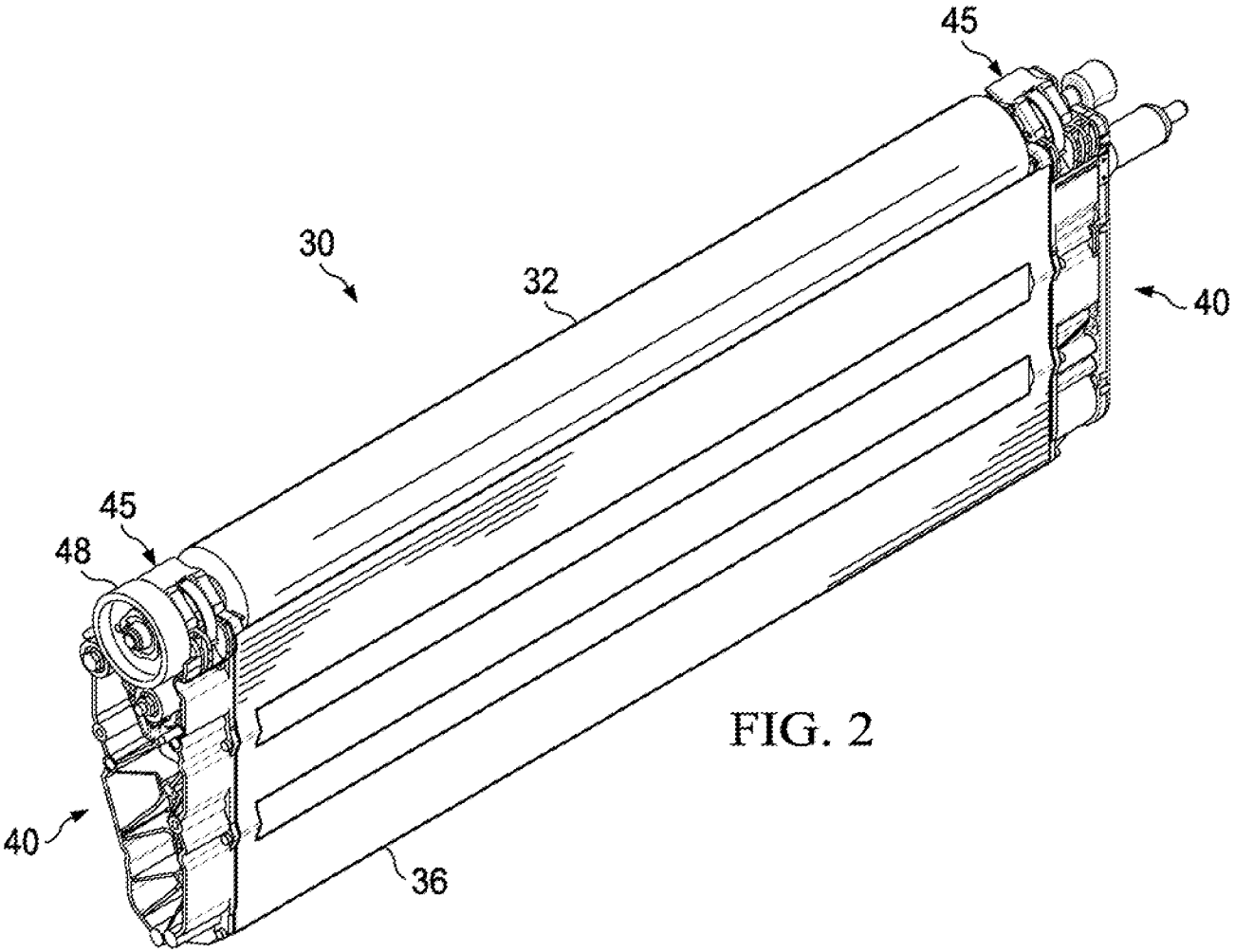
FIG. 2 shows a binary ink developer (BID) assembly with its clamps in a locked position in accordance with an example.

FIG. 2 illustrates an example of a BID assembly 30. As shown in the example, the BID assembly 30 includes a base assembly 36 which includes end caps 40 at opposing ends of the base assembly. The base assembly 36 receives the developer roller 32 at an upper end of the base assembly 36 as shown. The developer roller includes a gear, bearing, and handle assembly 48. Each end cap 40 includes a clamp 45 that locks the developer roller 32 in place on the base assembly 36. In FIG. 2, the clamps 45 are shown in a locked position.

Figure 3:
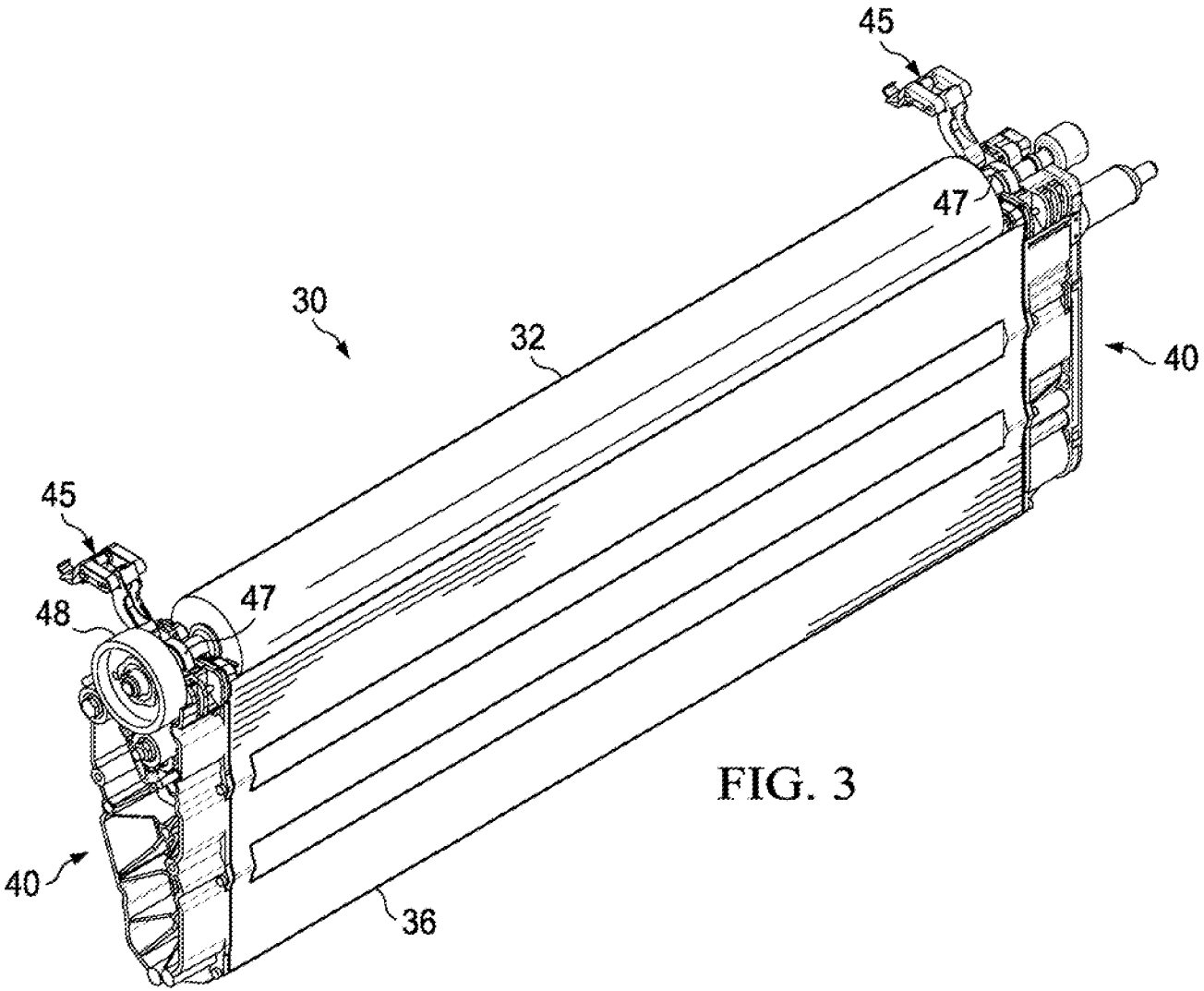
FIG. 3 shows a BID assembly with its clamps in an unlocked position in accordance with an example.
Figure 4:
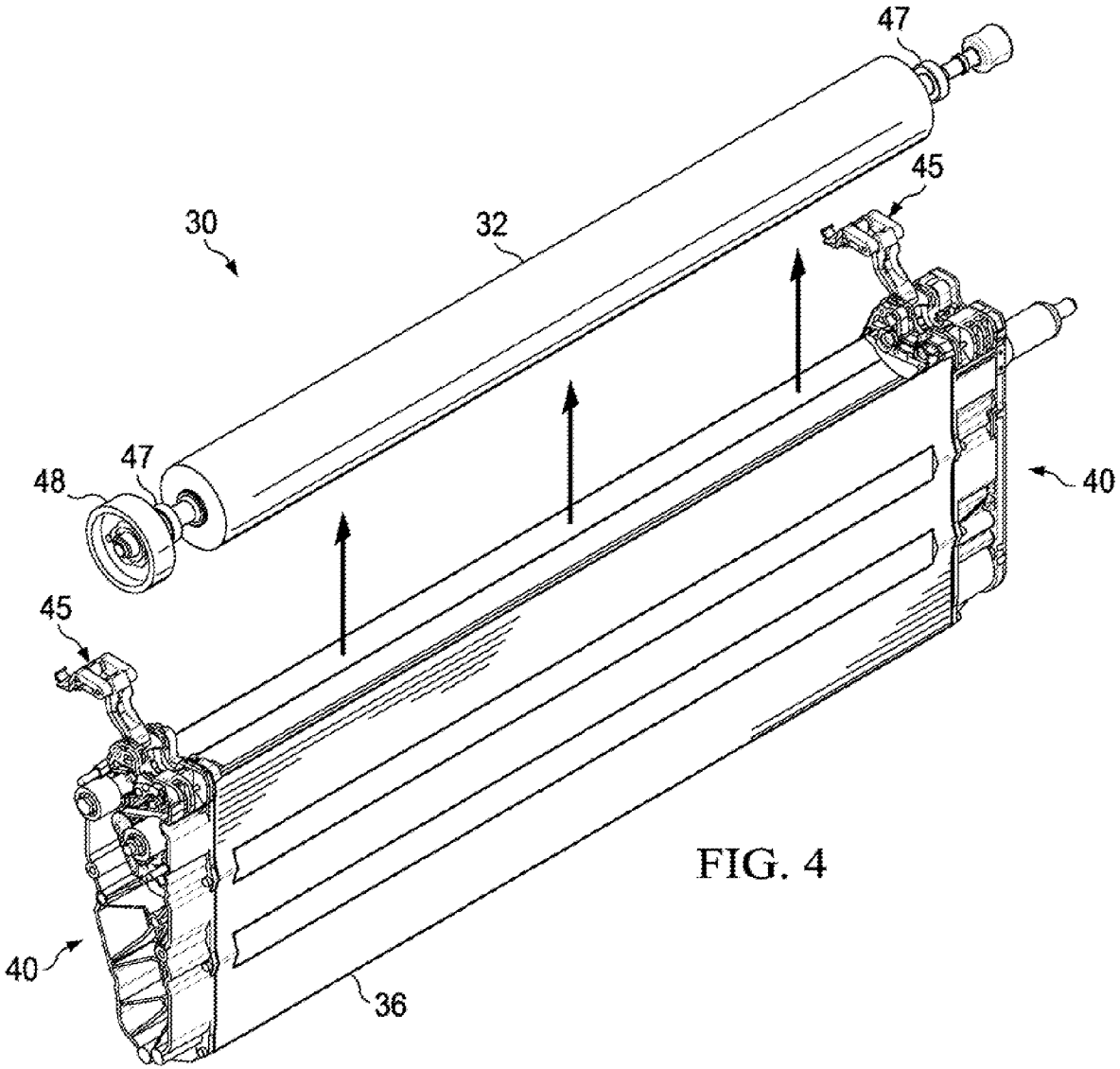
FIG. 4 shows a BID assembly with its clamps in an unlocked position and the developer roller removed from the BID assembly in accordance with an example.

FIG. 3 shows the clamps 45 in an unlocked position. The clamps 45 are hinged to the end caps 40 and are rotated between locked and unlocked positions to remove and replace the developer roller 32. FIG. 4 shows the developer roller 32 removed from the base assembly 36 of the BID assembly 30. Once the developer roller 32 is removed, a new developer roller 32 can be installed in the BID assembly 30 and locked in place by rotating the clamps to the locked position. FIGS. 3 and 4 also show rotary bearings 47 provided on opposing ends of the developer roller 32. The clamps 45 engage the rotary bearings 47 and apply sufficient force on the bearings to hold the developer roller in place.

Figure 5:
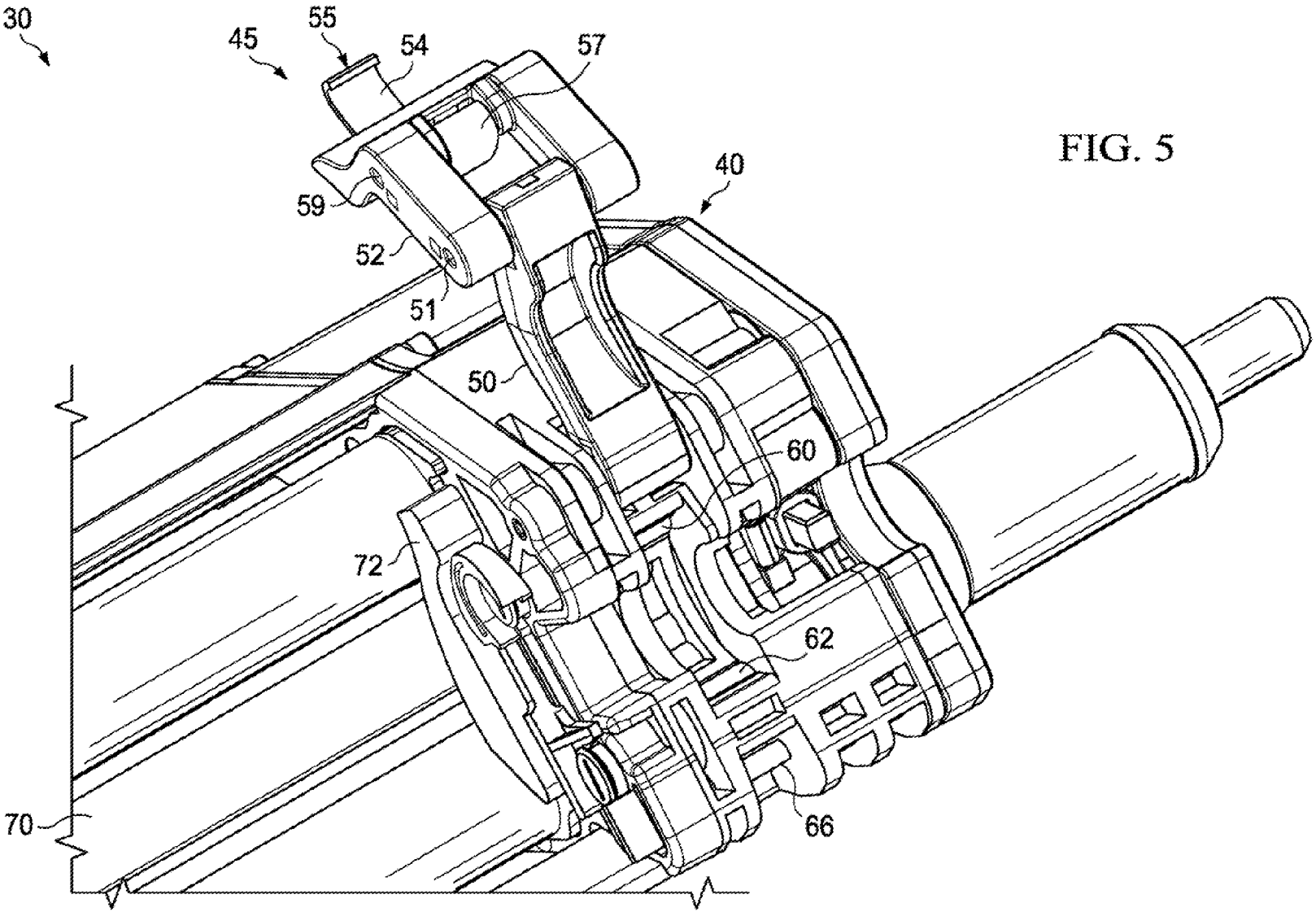
FIG. 5 shows a close-up view of one end of the BID assembly with a clamp in an unlocked position in accordance with an example.
Figure 6:
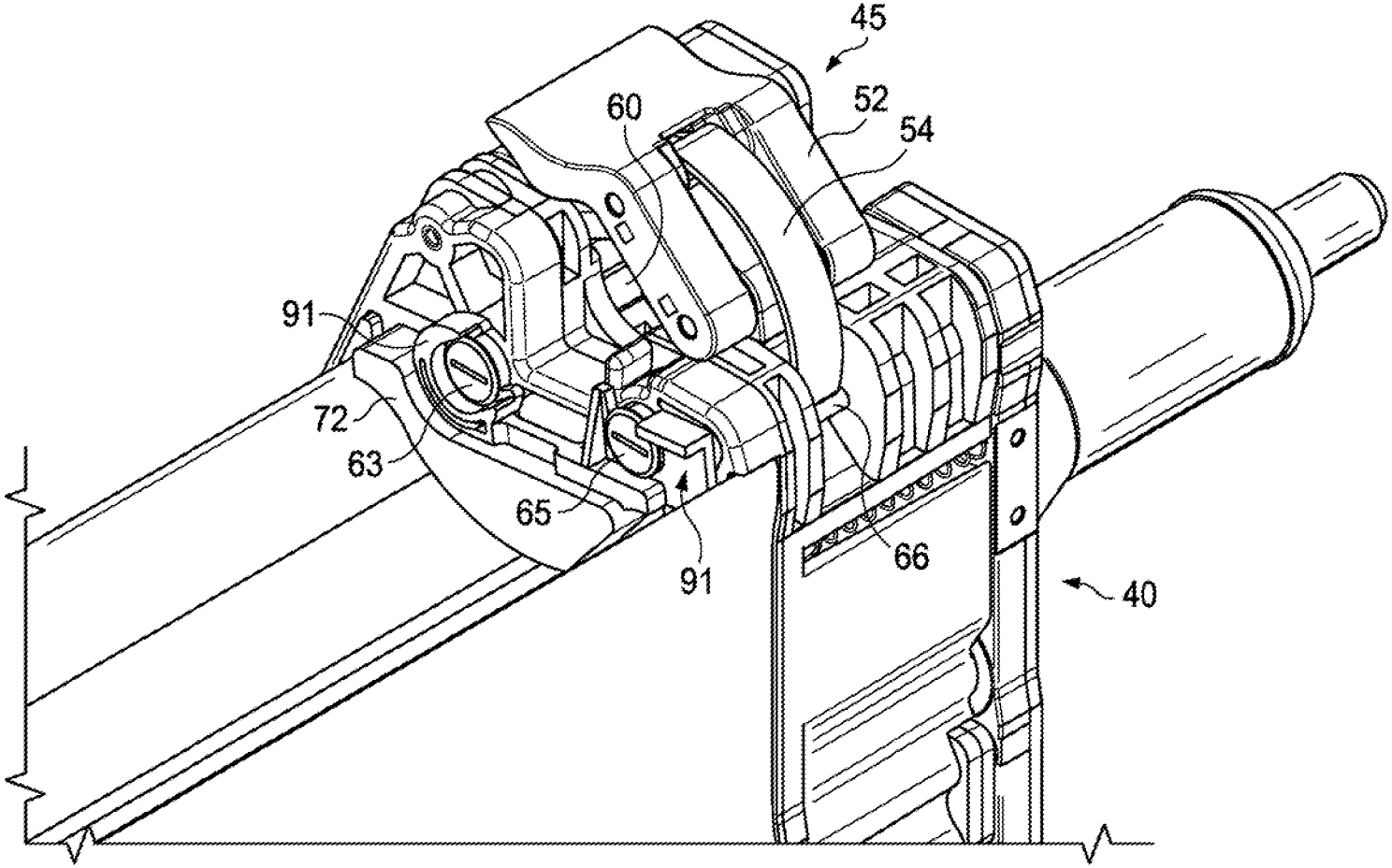
FIG. 6 shows a close-up view of one end of the BID assembly with a clamp in a locked position in accordance with an example.

FIGS. 5 and 6 provide close-up views of one end of the BID assembly 30. The developer roller 32 is not shown in FIGS. 5 and 6. The clamp 45 is in an unlocked position in FIG. 5 and in a locked position in FIG. 6. Referring to FIG. 5, in one implementation the clamp 45 comprises three components—a bearing race clamp 50, a handle 52, and a spring member 54. The bearing race clamp 50 is pinned to the end cap 40 as shown thereby permitting the bearing race clamp 50 to rotate between the locked and unlocked positions. The handle 52 is pinned to the bearing race clamp 50 by way of a pin 51. As such, the handle is able to rotate about pin 51 relative to the bearing race clamp 50. The spring member 54 in some implementations comprises a curved spring metal (e.g., steel) member. One end 57 of the spring member 54 is pinned to the handle 52 at a center portion of the handle by way of pin 59. The opposing end 55 of the spring member 54 is formed into a hook shape that engages a retaining pin 66 provided in the end cap 40. FIG. 6 shows the clamp 45 in a closed position with the hook shaped end 55 of the spring member 54 engaged at the retaining pin 66. FIGS. 5 and 6 also illustrate a seal 72 provided at the end cap. The seal is discussed below.

Figure 7:
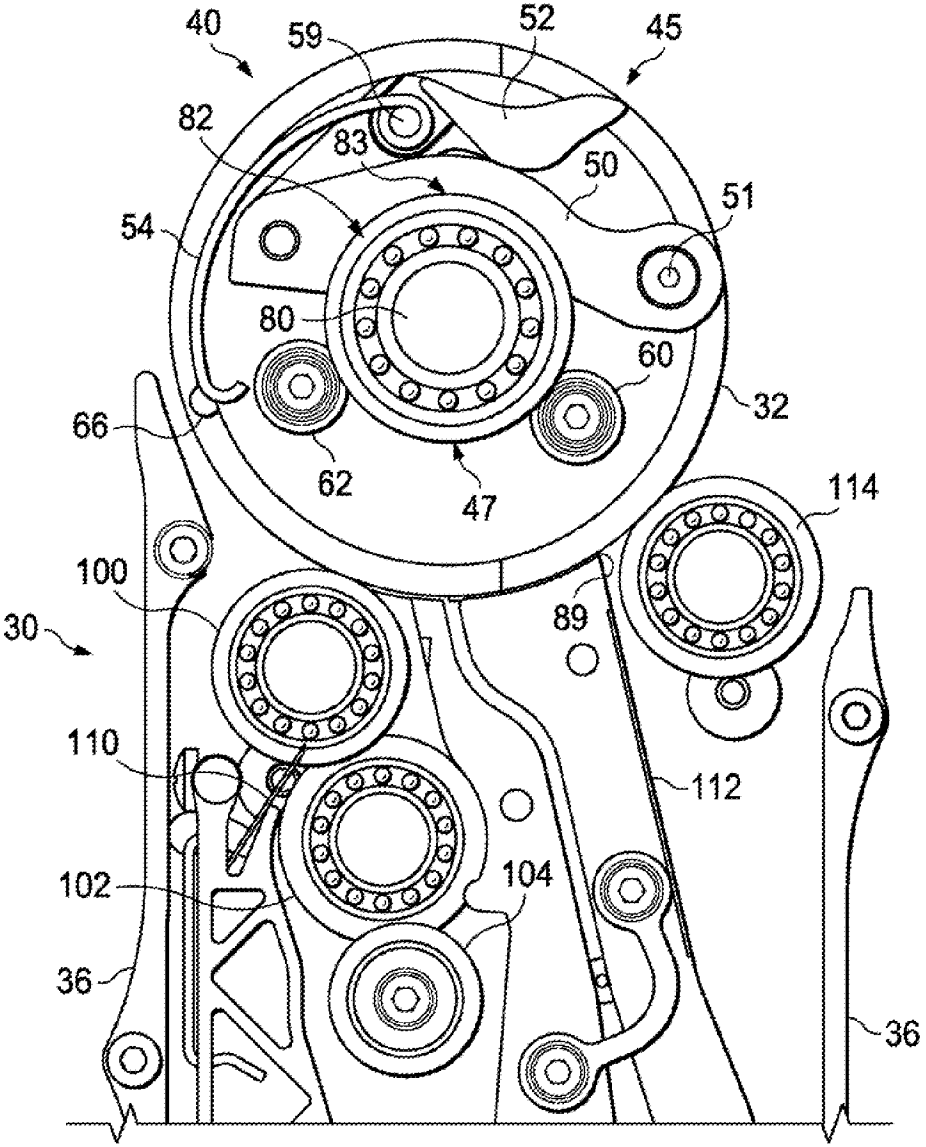
FIG. 7 shows a side view of one end of the BID assembly with a clamp in locked position in accordance with an example.

FIG. 7 shows a side view of an end cap 40. The BID base assembly 36 includes a number of components. In some embodiments, the BID base assembly 36 includes a cleaning roller 100, a sponge roller 102, a squeezer roller 104, a wiper 110, a main electrode 112, a squeegee roller 114, and other possible components. A potential bias between the main electrode 112 and the developer roller 32 initially transfers ink to the developer roller 32. The squeegee roller 114 regulates the ink film thickness on the developer roller 32. Ink is then selectively transferred from the developer roller 32 to the discharged portions of the surface of the photoconductor 12 (FIG. 1).

The cleaning roller 100 electrically removes substantially all remaining ink from the developer roller 32. The wiper 110 cleans the cleaning roller 100, and the sponge roller 102 cleans the wiper 110 and remixes the ink. The squeezer roller 104 then cleans the sponge roller 102.

Referring still to FIG. 7, the clamp 45 in FIG. 7 is shown in the locked position thereby locking the developer roller 32 in place. As noted above, both ends of the developer roller 32 include a rotary bearing 47. Each rotary bearing 47 includes a bearing outer race 82 which rotates relative to a bearing inner race 80. The bearing inner race 80 is locked to the developer roller 32 and thus rotates with the developer roller. The bearing outer race 82 can rotate independent of the bearing inner race 80 and developer roller 32. The bearing race clamp 50 is forced into contact with the bearing outer race 82 as a result of the force created by the spring member 54. The bearing race clamp 50 has a substantially planar portion 83 that contacts the bearing outer race 82.

The force applied by the bearing race clamp 50 on the bearing out race 82 causes the bearing outer race into contact with developer roller datum pins 60 and 62. These pins are also shown in FIG. 5. As a result of the force on the developer roller's bearing outer race 82 as well as the location of the datum pins 60 and 62, the developer roller 32 is restrained in precisely the correct position. A small gap 89 (e.g., about 500 microns in one example) between the developer roller 32 and the main electrode 142 is needed for proper operation of the developer roller. The position of the developer roller relative to the main electrode 112 is tightly controlled by the datum pins 60 and 62 and the clamp's bearing race clamp 50. The developer roller datum pins 60 and 62 are positioned so that, when the bearing outer race 82 is clamped in place, the datum pins are approximately 120 degrees apart about the outer circular perimeter of the bearing outer race. In some implementations, the datum pins are spaced about 117 degrees apart, and the center point of contact of the bearing race clamp 50 may be spaced about 121 degrees from each datum pin 60, 62. The combination of the bearing race clamp 50 and the two datum pins 60 and 62 function as a V-block clamp.

The spring member 54 facilitates the correct amount of force to be applied to the developer roller's outer bearing race 82, and thus to the developer roller itself. In some implementations, force in the range of 50-600 Newtons is generated by the action of the spring member 54.

Referring again to FIG. 6, developer roller datum pin 60 is shown, but datum pin 62 is hidden from view. Each datum pin is installed in the end cap 40. In some implementations, each datum pin 60, 62 comprises a solid cylindrical member (circular cross sectional area) made from a suitable material such as a metal (e.g., aluminum). Each datum pin has a longitudinal dimension that extends in a direction generally orthogonal to the rotational direction of the clamps 45. Each datum pin 60, 62 has a head portion 63, 65 that sits in a retaining portion 91 of the end cap 40. The retaining portion 91 sits on top of seal 72. When the clamp 45 is rotated to the locked position, the downward force on the developer roller's bearing 47 also causes the retaining portion 91 to engage the seals 47 which prevent toner fluid from penetrating from the main electrode 112 and developer 32 into the area of the end cap 40.

Figure 8:
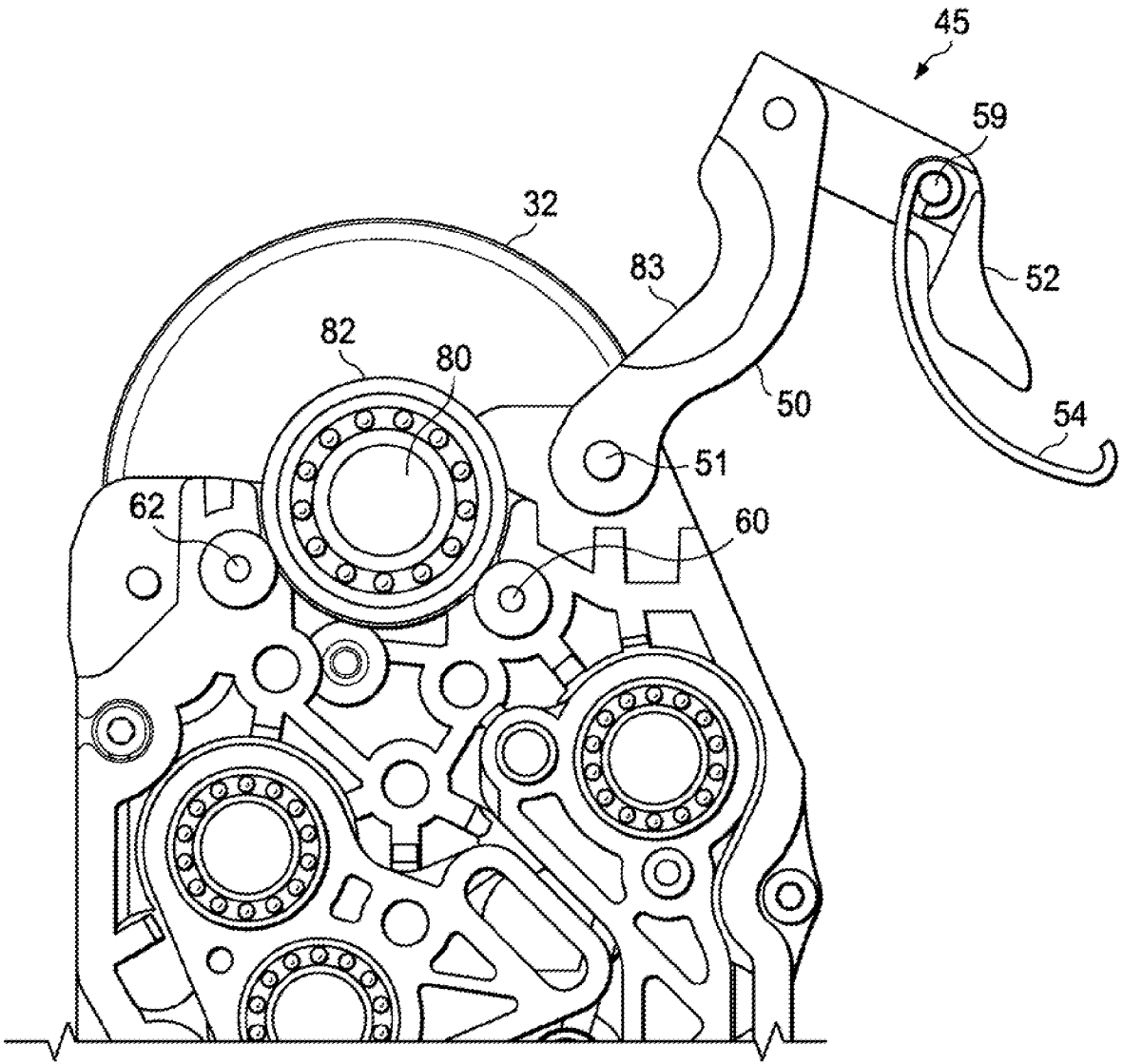
FIG. 8 shows a side view of one end of the BID assembly with a clamp in an unlocked position in accordance with an example.

FIG. 8 is a similar view to that of FIG. 7 but shows the clamp 45 in an unlocked position. With the clamp in this position, the developer roller 32 can be removed from the BID assembly 30 and replaced with a different developer roller 32.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An apparatus to receive a developer roller for a printing device, comprising:

a base assembly including end caps at opposing ends of the base assembly, said base assembly includes a receptacle for a developer roller having a rotary bearing on opposing ends of the developer roller;

each end cap including a first datum pin, a second datum pin, and a clamp containing a spring member;

wherein each clamp, when locked in place in part by action of the spring member, is to push against a corresponding rotary bearing when the developer roller is installed in the base assembly, said rotary bearing being forced by the clamp into contact with the first and second datum pins to position the developer roller in the base assembly.

2. The apparatus of claim 1 wherein the first and second datum pins are positioned within each end cap so as to contact the rotary bearing at points approximately 120 degrees apart.

3. The apparatus of claim 1 wherein each clamp pivots along a rotational direction and each datum pin includes a long dimension that extends in a direction orthogonal to said rotational direction.

4. The apparatus of claim 1 wherein the clamp comprises a multi-hinged clamp.

5. The apparatus of claim 1 wherein the clamp comprises a bearing latch clamp rotationally connected to the end cap and rotationally connected to a handle, and the spring member connected to said handle.

6. The apparatus of claim 1 wherein the clamp comprises a substantially planar clamp surface that is to contact the rotary bearing when the clamp is forced into a locked position.

7. The apparatus of claim 1 wherein the spring member comprises a spring steel member that includes a hook to engage a retaining pin provided in the end cap.

8. The apparatus of claim 1 wherein the spring member is curved.

9. A binary ink developing (BID) system, comprising:

a base assembly;

a developer roller to reside in the base assembly, said developer roller having a rotary bearing on opposing ends of the developer roller;

each of multiple ends of the base assembly including a first datum pin, a second datum pin, and a clamp containing a spring member;

wherein each clamp, when locked in place in part by action of the spring member, is to push against a corresponding rotary bearing when the developer roller is installed in the base assembly, said rotary bearing being forced by the clamp into contact with the first and second datum pins to position the developer roller in the base assembly.

10. The BID of claim 9 wherein the first and second datum pins are positioned within each end cap so as to contact the rotary bearing at points approximately 120 degrees apart.

11. The BID of claim 9 wherein each clamp pivots along a rotational direction and each datum pin includes a long dimension that extends in a direction orthogonal to said rotational direction.

12. The BID of claim 9 wherein the clamp comprises a multi-hinged clamp.

13. The BID of claim 9 wherein the clamp comprises a bearing latch clamp rotationally connected to the end cap and rotationally connected to a handle, and the spring member connected to said handle.

14. The BID of claim 9 wherein the clamp comprises a substantially planar clamp surface that is to contact the rotary bearing when the clamp is forced into a locked position.

15. The BID of claim 9 wherein the spring member comprises a spring steel member that includes a hook to engage a retaining pin provided in the end cap.

16. A printing system, comprising:

a photoconductor; and a BID assembly to cause liquid toner to be applied to said photoconductor;

wherein the BID assembly comprises a base assembly including end caps at opposing ends of the base assembly, said base assembly includes a receptacle for a developer roller having a rotary bearing on opposing ends of the developer roller;

each end cap including a first datum pin, a second datum pin, and a clamp containing a spring member; and wherein each clamp, when locked in place in part by action of the spring member, is to push against a corresponding rotary bearing when the developer roller is installed in the base assembly, said rotary bearing being forced by the clamp into contact with the first and second datum pins to position the developer roller in the base assembly.

17. The printing system of claim 16 wherein each clamp pivots along a rotational direction and each datum pin includes a long dimension that extends in a direction orthogonal to said rotational direction.

18. The printing system of claim 16 wherein the clamp comprises a bearing latch clamp rotationally connected to the end cap and rotationally connected to a handle, and the spring member connected to said handle.

19. The printing system of claim 16 wherein the clamp comprises a substantially planar clamp surface that is to contact the rotary bearing when the clamp is forced into a locked position.

20. The printing system of claim 16 wherein the spring member comprises a spring steel member that includes a hook to engage a retaining pin provided in the end cap.

* * * * *